US007806441B2

(12) United States Patent
Motto

(10) Patent No.: US 7,806,441 B2
(45) Date of Patent: Oct. 5, 2010

(54) SNOWBOARD SUPPORT SYSTEM

(76) Inventor: David Louis Motto, 40 Cindy Rd., Ellington, CT (US) 06029

( * ) Notice: Subject to any disclaimer, the term of this patent is extended or adjusted under 35 U.S.C. 154(b) by 782 days.

(21) Appl. No.: 11/477,082

(22) Filed: Jun. 28, 2006

(65) Prior Publication Data

US 2008/0001389 A1 Jan. 3, 2008

(51) Int. Cl.
*A63C 11/02* (2006.01)

(52) U.S. Cl. ..... 280/809; 280/814

(58) Field of Classification Search ..... 280/809, 280/814, 815

See application file for complete search history.

(56) References Cited

U.S. PATENT DOCUMENTS

| | | | | |
|---|---|---|---|---|
| 3,825,274 | A * | 7/1974 | Weinstein | 280/623 |
| 4,013,318 | A * | 3/1977 | Piper | 297/423.4 |
| 4,188,061 | A * | 2/1980 | Shehi | 296/76 |
| 5,564,729 | A | 10/1996 | Gomez et al. | |
| 5,653,467 | A * | 8/1997 | Griffin et al. | 280/809 |
| 5,951,048 | A * | 9/1999 | Slaughter | 280/814 |
| 6,059,499 | A * | 5/2000 | Bird | 410/103 |
| 6,217,071 | B1 * | 4/2001 | Shia | 280/809 |
| 6,217,073 | B1 * | 4/2001 | Hoffman | 280/823 |
| 6,290,260 | B1 | 9/2001 | Brill | |
| 6,321,470 | B2 | 11/2001 | Zazzi | |
| 6,349,968 | B1 | 2/2002 | Crego et al. | |
| 6,457,746 | B1 | 10/2002 | Maguire | |
| 6,524,041 | B1 * | 2/2003 | Voiculescu | 410/100 |
| 6,702,328 | B2 * | 3/2004 | Malleis et al. | 280/809 |
| 6,929,438 | B1 * | 8/2005 | Foster et al. | 410/46 |
| 7,222,883 | B1 * | 5/2007 | Furlani | 280/809 |
| 7,484,765 | B2 * | 2/2009 | Harper | 280/809 |
| 2002/0130508 | A1 * | 9/2002 | Schepers | 280/809 |
| 2002/0130509 | A1 * | 9/2002 | Leaf et al. | 280/814 |
| 2003/0059269 | A1 * | 3/2003 | Bosley | 410/100 |
| 2006/0113787 | A1 * | 6/2006 | Siebrecht | 280/809 |
| 2006/0188354 | A1 * | 8/2006 | Bosley | 410/23 |
| 2007/0169396 | A1 * | 7/2007 | O'Neill et al. | 43/21.2 |
| 2007/0189873 | A1 * | 8/2007 | Breeden | 410/100 |
| 2008/0001389 | A1 * | 1/2008 | Motto | 280/814 |
| 2008/0111015 | A1 * | 5/2008 | Furlani | 242/404 |

* cited by examiner

*Primary Examiner*—Jeffrey J Restifo

(57) ABSTRACT

A Snowboard Support System capable of relieving the load placed on the snowboarder's bound downhill foot and leg while riding on a chair lift. This invention is lightweight, compact, self retractable and safe. Most notably, the Snowboard Support System comprises a hooking mechanism that attaches to the chair lift, has an emergency releasable buckle, and an adjustment mechanism to change the length of the webbing to suit each snowboarder's height. The hooking mechanism is self retracted into an outer structure via a spring mechanism. The outer structure is fixed to the snowboard via U brackets and threaded inserts.

23 Claims, 5 Drawing Sheets

SNOWBOARD SUPPORT SYSTEM

BACKGROUND OF THE INVENTION

The problems faced by today's snowboarders are that the chair lift mechanisms have been designed for skiers. Due to the large capital expense of these chair lifts, they have not been re designed to accommodate today's snowboarders.

A snowboarder will mount the chair lift with his or her downhill foot bound to the snowboard leaving the other foot free. Once loaded and aloft in the chair lift, the combined weight of the snowboard and boot pull down on the downhill foot which is still bound to the snowboard. During the ride up the mountain, the wind will catch the sail area of the snowboard and add increased force on the snowboarder's leg. This results in typically cutting off circulation to the downhill foot and leg. This also makes disembarking the chair lift difficult as the snowboarder's downhill foot and leg are fatigued and possibly numb or 'asleep'.

The purpose of this invention is to relieve the load placed on the snowboarder's downhill foot and leg while riding on a chair lift. It is a further purpose of this invention to also be lightweight, compact, self retractable and user friendly.

Various products in the marketplace disclose various methods of supporting a snowboard. U.S. Pat. No. 6,457,746 to Schepers lacks many of the features of the present invention namely a safety release mechanism, a spring loaded self retractable mechanism, and a compact all inclusive outer structure designed to accommodate the hooking mechanism itself.

U.S. Pat. No. 6,349,968 to Crego lacks the outer structure fixedly attached to the snowboard, provides no way of self-retracement of the chord or webbing, and lacks no safety release mechanism of the hook in case the mechanism freezes in the locked position to the chair lift.

U.S. Pat. No. 6,321,470 to Zazzi simply uses an article attached to the end of the free boot of the snowboarder to help support the snowboard on the chair lift ride up the mountain. No elements of the present invention are in this patent to Zazzi.

U.S. Pat. No. 6,290,260 to Brill uses a loop strap that fits over the snowboarder's unbound leg and under the snowboard itself to support the weight of the snowboard. No elements of the present invention are seen in the invention to Brill.

U.S. Pat. No. 5,564,729 to Gomez shows a quite complicated harness that fits around the user's thorax and is coupled to the user's bound leg and to the snowboard itself. The invention appears quite cumbersome and complicated in hooking up straps for each chair ride, while not providing a means for easy storage while actually snowboarding down the mountain.

BRIEF SUMMARY OF THE INVENTION

The present invention provides a snowboard support system that relieves the load of the snowboard normally placed on the snowboarder's downhill foot during the chair lift ride. It is self retractable, compact when not in use, user friendly, uncomplicated, lightweight to not alter the flexibility of the board nor affect the center of gravity, and includes a safety release mechanism to disengage the hook from the rest of the system.

BRIEF DESCRIPTION OF THE DRAWINGS

In the drawings, like elements are depicted by like reference numerals. The drawings are briefly described as follows.

| ELEMENT | DRAWING NUMBER |
|---|---|
| HOOKING MECHANISM | 1 |
| WEBBING | 2 |
| OUTER STRUCTURE | 3 |
| PULL TAB | 4 |
| PUSH BUTTON RELEASE MECHANISM (female portion) | 5 |
| PUSH BUTTON RELEASE MECHANISM (male portion) | 5a |
| U BRACKET | 6 |
| RETENTION STRAP or RETENTION BAR | 7 |
| ROUNDED LIPS or BEARING SUPPORTED ELONGATED WHEELS | 8 |
| DRAIN HOLE(s) | 9 |
| COMMON SHAFT | 10 |
| WEBBING LOCK SLIT | 11 |
| GUIDANCE COLLARS | 12 |
| BEARING ASSEMBLIES | 13 |
| RETRACTABLE SPRING MECHANISM(s) | 14 |
| EXTERIOR WHEEL | 15 |
| U SHAPED FEMALE DEPRESSIONS (for U BRACKET) | 16 |
| RETENTION BAR VERTICAL PROJECTIONS | 17 |
| HOOK | 18 |
| "V" "U" OR RECTANGULAR FEMALE DEPRESSIONS (for HOOK) | 19 |
| FINGER DEPRESSION | 20 |

DETAILED DESCRIPTION OF THE PREFERRED EMBODIMENTS

Figure 1:
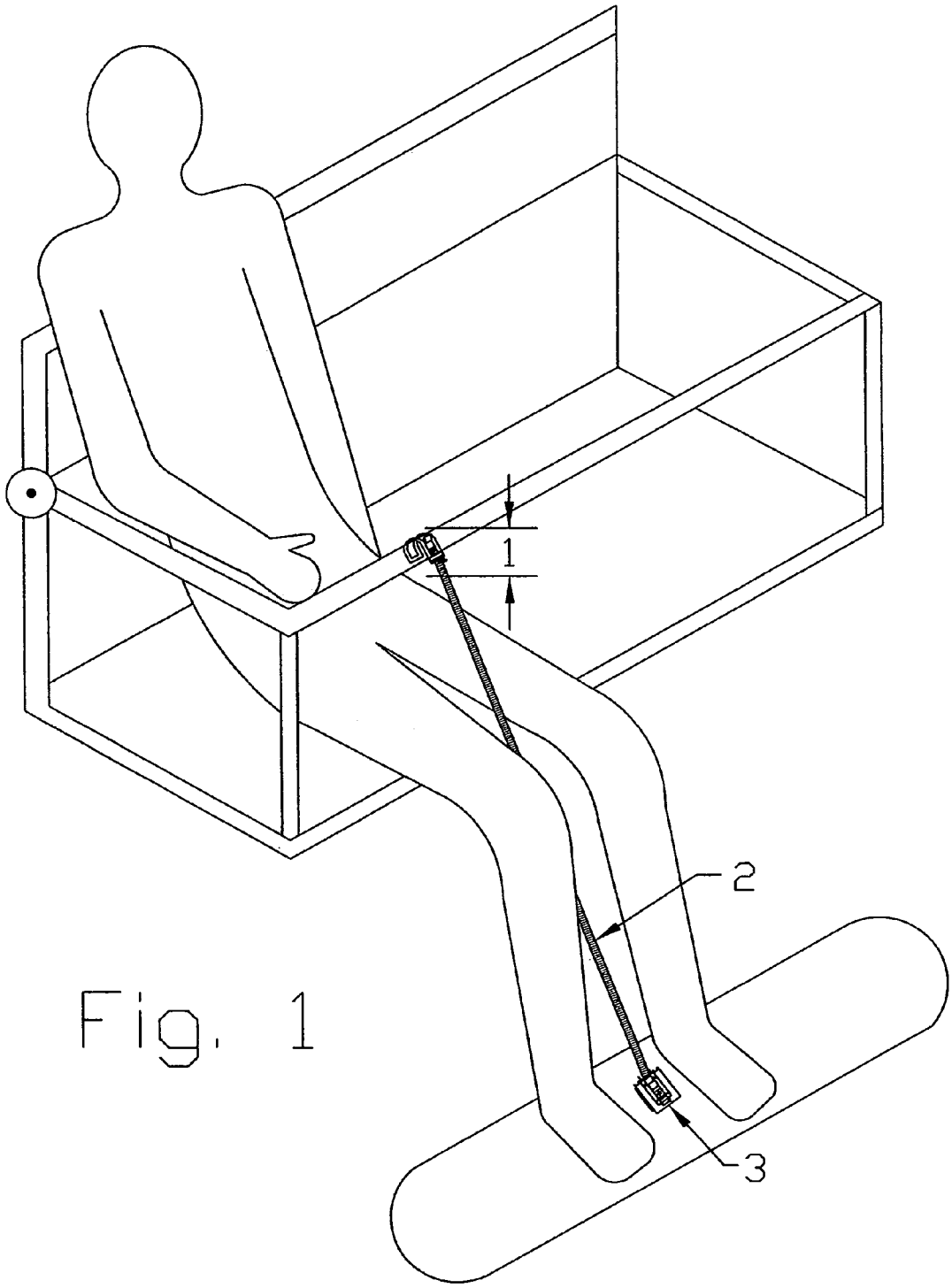
FIG. 1 shows how the invention, the Snowboard Support System, is used in combination with the snowboard, the user, and the chair lift.

As seen in FIG. 1, there are three main components to the invention. Mounted to the Snowboard is the OUTER STRUCTURE (3). While not in use, the OUTER STRUCTURE (3) houses the WEBBING (2) and the HOOKING MECHANISM (1). The WEBBING (2) connects the OUTER STRUCTURE (3) to the HOOKING MECHANISM (1). The HOOKING MECHANISM (1) attaches to a chair lift. All three components together when in use serve to take the load of the snowboard and the wind resistance off the snowboarders downhill foot which remains connected to the snowboard during the chair lift ride.

Figure 4:
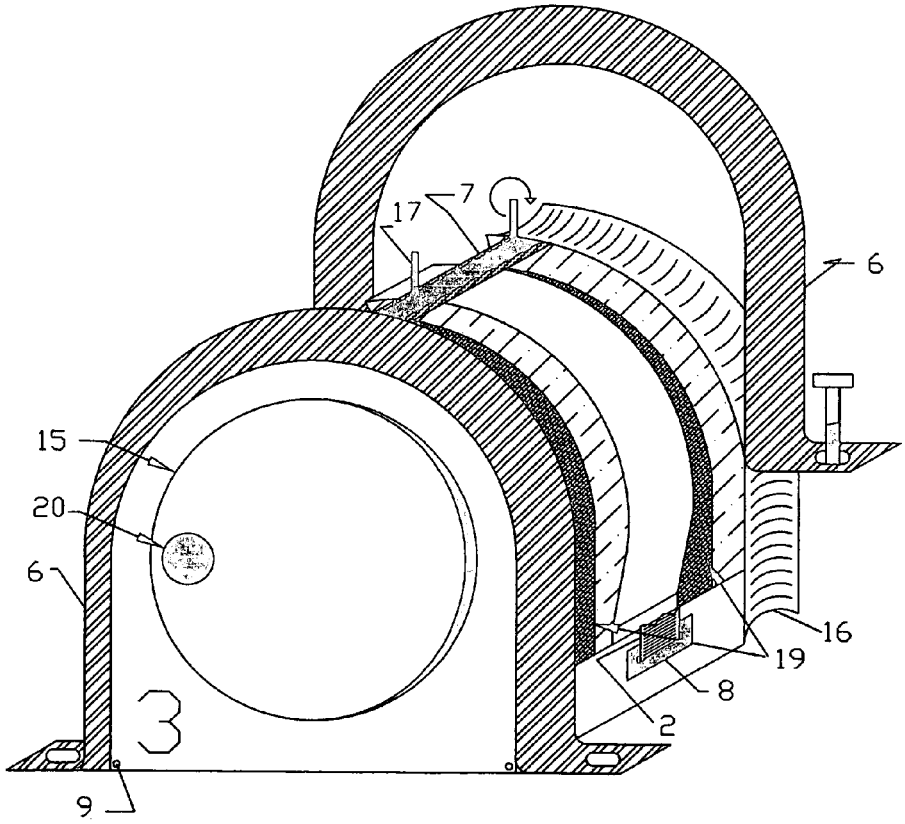
FIG. 4 shows the Snowboard Support System's Outer Structure external from an isometric view.

As seen in FIG. 4, the OUTER STRUCTURE (3) of the SNOWBOARD SUPPORT SYSTEM can be attached to the snowboard using two U BRACKETS (6) at either end of the snowboard support system and fitting into U SHAPED FEMALE DEPRESSIONS (16) in the OUTER STRUCTURE (3) of the SNOWBOARD SUPPORT SYSTEM. The round U BRACKETS (6) have flat ends bent at 90 degrees relative to the U BRACKET (6) at each end. In the center of these flat ends is a hole meant to receive a screw, bolt, or other hardware which fastens to the snowboard via threaded inserts. These threaded inserts are similar to how the bindings are secured to the snowboard. Alternatively, the snowboard support system can use hardware screwed or bracketed through the base of the SNOWBOARD SUPPORT SYSTEM at each of the four corners and secured into the snowboard via threaded inserts, although the first system comprising the U BRACKETS (6) is preferable due to its simplicity.

Figure 2:
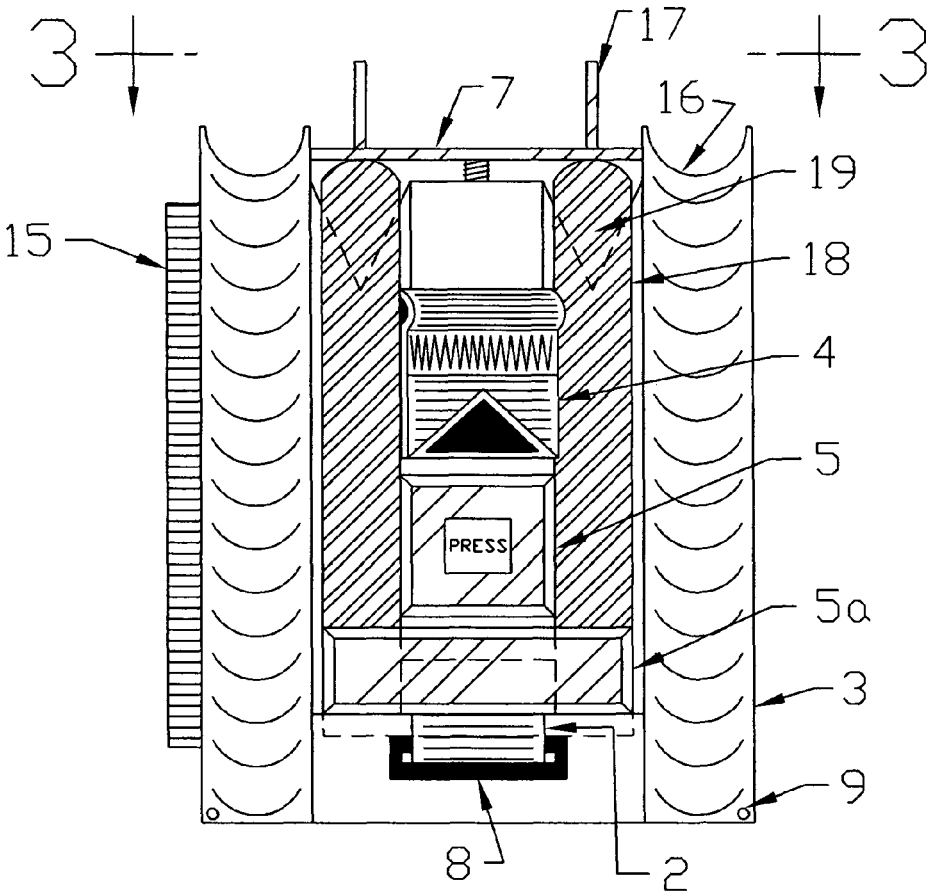
FIG. 2 shows the Snowboard Support System's Outer Structure externals from a front view.
Figure 3:
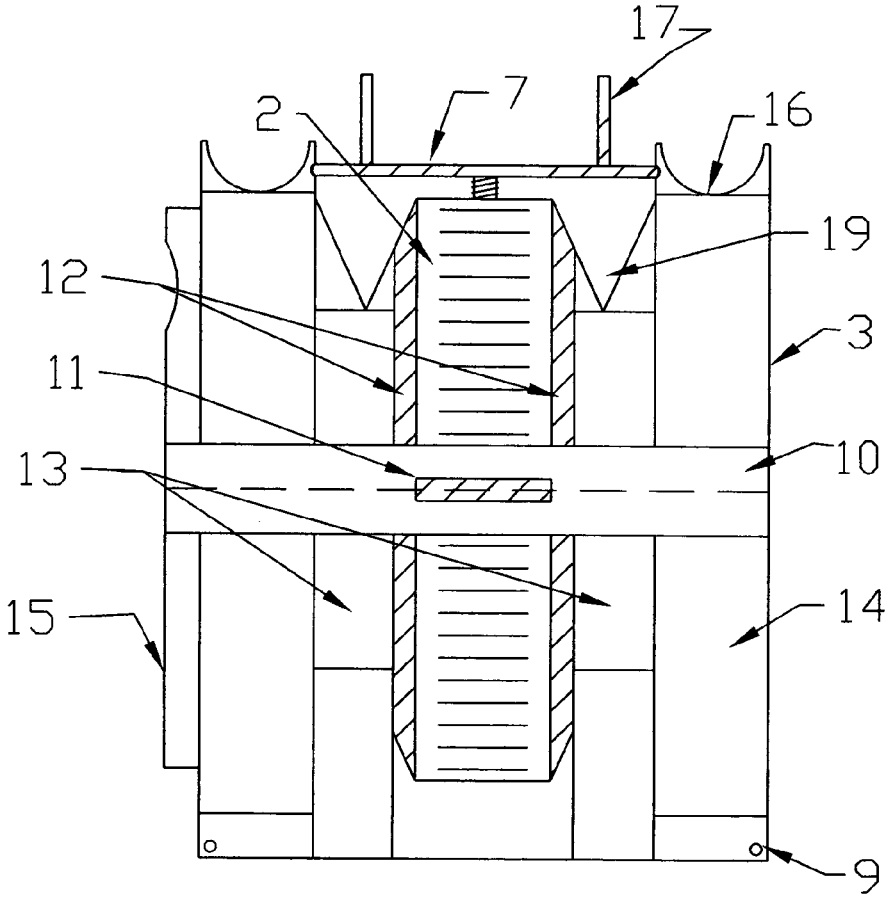
FIG. 3 shows the Snowboard Support System's Outer Structure cross-sectional from a front view.

As seen in FIGS. 2 and 3, the OUTER STRUCTURE (3) of the SNOWBOARD SUPPORT SYSTEM has "V", "U", or RECTANGULAR SHAPED FEMALE DEPRESSIONS (19) made to house the HOOK (18) while in storage. The "V" SHAPED FEMALE DEPRESSIONS embodiment is shown. These female depressions are made deep enough to house multiple size HOOKs (18). The reason for multiple size hooks is that chair lift safety bars are not standard diameter throughout the world.

As seen in FIG. 2, the HOOKING MECHANISM (1) is securely housed in the OUTER STRUCTURE (3) when not in use by a RETENTION BAR (7). The RETENTION BAR (7) is composed of a rectangular flat bar with a slight curvature at its ends. The RETENTION BAR (7) is affixed to the OUTER STRUCTURE (3) at the center of the bar and provides a point of rotation. This point of rotation has a spring cam mechanism where the user pushes down against the spring and turns the RETENTION BAR (7) 90 degrees to allow the HOOKING MECHANISM (1) to be removed. This process is repeated to house and secure the HOOKING MECHANISM (1) when returning it to the OUTER STRUCTURE (3). In conjunction with the spring cam mechanism, the rectangular flat bar has rounded ends which are meant to frictionally engage into slight depressions in the side walls of the OUTER STRUCTURE (3). Rising vertically from the RETENTION BAR (7) are RETENTION BAR VERTICAL PROJECTIONS (17) near either end to be used by the user's thumb and forefinger to operate the RETENTION BAR.

Another embodiment of the RETENTION BAR (7) is instead of a rigid rectangular bar, a strap made of similar material to that of the webbing used in back pack adjustable straps is used to secure the HOOKING MECHANISM (1) while in storage. This RETENTION STRAP (7) (not shown in the drawings) can be affixed in one of three ways.

The first method (not shown in drawings) uses material which is known by the trade name Velcro® webbing. One end of the RETENTION STRAP (7) is secured to the OUTER STRUCTURE (3) at the location where one end of the previously stated RETENTION BAR (7) would make contact with the OUTER STRUCTURE (3). The RETENTION STRAP (7) is threaded through a very thin rectangular hoop at mid length of the RETENTION STRAP (7). The rectangular hoop in turn is fixedly secured to the OUTER STRUCTURE (3) opposite where the RETENTION STRAP (7) is secured to the OUTER STRUCTURE (3) and where the other end of the RETENTION BAR (7) makes contact with the OUTER STRUCTURE (3). It is here where the RETENTION STRAP (7) turns back 180 degrees upon itself, overlapping where the unique male 'hook' features of the Velcro webbing engage the 'fuzzy' female features. This interaction of the 'hook' and 'fuzzy' features secures the HOOK STRAP to itself. Because the RETENTION STRAP (7) spans the HOOK (18), it also secures the HOOK (18) into the V, U, or RECTANGULAR SHAPED FEMALE DEPRESSIONS (19) of the OUTER STRUCTURE (3).

The second method (not shown in drawings) of the RETENTION STRAP (7) comprises a strap made of similar material to that of the webbing used in back pack adjustable straps. Again, one end of the RETENTION STRAP (7) is secured to the OUTER STRUCTURE (3) via a snap button at the location where one end of the previously stated RETENTION BAR (7) would make contact with the OUTER STRUCTURE (3). The strap spans across the HOOK (18) and secures itself where the other end of the RETENTION BAR (7) makes contact with the OUTER STRUCTURE (3) via a second snap button.

As seen in FIGS. 2 and 4, is where the WEBBING (2) exits from the OUTER STRUCTURE (3). Simpler models will have a rounded lip at all four corners of the exit of the WEBBING (2). The ROUNDED LIPS (8) are located one on top, one on bottom and on either side to reduce friction and prevent fraying of the WEBBING (2) as it is extracted and retracted. More expensive models will have a BEARING SUPPORTED ELONGATED WHEEL (8), one on top and one on bottom with rounded lips on either side of the WEBBING (2) to reduce the friction and thus the fraying of the WEBBING (2). The close proximity between the WEBBING (2) and the OUTER STRUCTURE (3) is important to prevent snow or ice from getting inside the SNOWBOARD SUPPORT SYSTEM, melting, and rusting out the bearings. Because this is a possibility, small DRAIN HOLE(s) (9) are located at each corner at the base of the SNOWBOARD SUPPORT SYSTEM to allow any water to drain out.

The HOOKING MECHANISM (1), while deployed, is meant to have the WEBBING (2) run the full length out of the SNOWBOARD SUPPORT SYSTEM for each chair lift ride. As shown in FIG. 3, the RETRACTABLE SPRING MECHANISM(s) (14), located in the OUTER STRUCTURE (3), gets mechanically charged when the user deploys the HOOKING MECHANISM (1) and runs the full length of the WEBBING (2) out of the OUTER STRUCTURE (3). The force of the RETRACTABLE SPRING MECHANISM(s) (14) is sufficient to re wind the WEBBING (2) when the user wishes to store the HOOKING MECHANISM (1), for example, prior to off loading the chair lift. In case of malfunction of the RETRACTABLE SPRING MECHANISM(s) (14), an EXTERIOR WHEEL (15) with a rounded depression meant to be used by a finger or thumb to crank in the WEBBING (2), is located at one end of the OUTER STRUCTURE (3).

Figure 5:
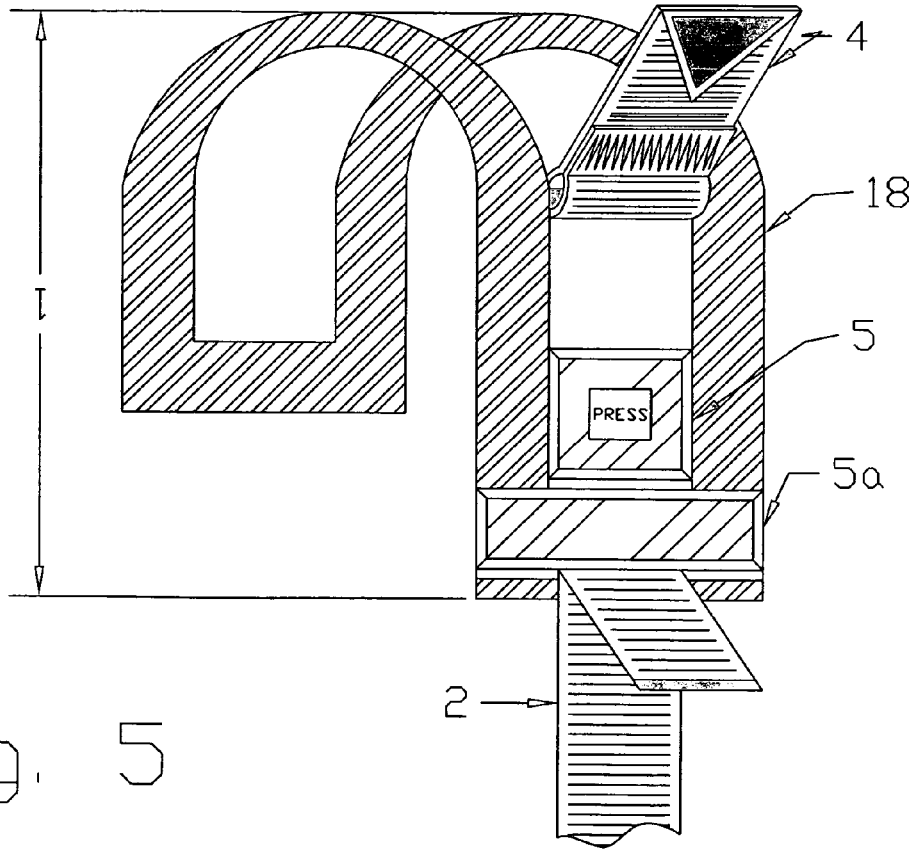
FIG. 5 shows the Snowboard Support System's Hooking Mechanism from an isometric view.

As shown in FIG. 5, the HOOKING MECHANISM (1) comprises a HOOK (18) which consists of either one or two "fingers", preferably two fingers, for contacting the chair lift bar. The HOOK (18) can have multiple fingers joined together at their ends (not shown in drawings) to eliminate sharp projections and possible hazards to personnel. Another embodiment (shown in FIG. 5) is to have a horizontal bar join both ends of the fingers also eliminating sharp projections and possible hazards to personnel.

As shown in FIG. 5, the HOOKING MECHANISM (1) also comprises a PULL TAB (4) made of webbing folded over upon itself and is rigidly attached to the HOOKING MECHANISM (1). The function of this is to allow the user to pull the HOOKING MECHANISM (1) out of the OUTER STRUCTURE (3) using gloves with or without fingers. Another embodiment is to have a small rigid "finger hook" (not shown in drawings) in place of the PULL TAB (4). The rigid finger hook is large enough for the user to get a finger or thumb in and lift the HOOKING MECHANISM (1) out of the OUTER STRUCTURE (3) and off the chair lift bar.

As shown in FIG. 5, the HOOKING MECHANISM (1) also consists of a rigidly attached PUSH BUTTON RELEASE MECHANISM (5 and 5*a*). The female portion of the PUSH BUTTON RELEASE MECHANISM (5) is rigidly and permanently attached to the HOOK (18). The male portion of the PUSH BUTTON RELEASE MECHANISM (5*a*) has an adjustment mechanism to change the length of the WEBBING (2). The WEBBING (2) can be adjusted to suit the two variables, the user's leg length and the height of the chair lift bar where the HOOKING MECHANISM (1)

attaches to. The other end of the WEBBING (2) is permanently attached to the OUTER STRUCTURE (3) via the COMMON SHAFT's (10) WEBBING LOCK SLIT (11) and is thus non adjustable at this end. This method of permanently attaching the WEBBING (2) to the COMMON SHAFT (10) is accomplished by having the WEBBING (2) pass through a slit in the axis of the COMMON SHAFT (10) and then being stitched upon itself. Another method of securing the WEBBING (2) is to have a re-enforced mouth at one end of the WEBBING (2). The re-enforced mouth would be slightly wider than the WEBBING (2) to accommodate for stitching around the mouth—thereby making the mouth opening as wide as the WEBBING (2) itself. The purpose of this is that the opposite end of the WEBBING (2) passes through the WEBBING LOCK SLIT (11) first and secondly through the re-enforced mouth at its opposite end thus trapping and locking the WEBBING (2) around the COMMON SHAFT (10).

As shown in FIG. 3's cross section of the OUTER STRUCTURE (3), the COMMON SHAFT (10) has GUIDANCE COLLARS (12) on either side of the WEBBING (2) to ensure the WEBBING (2) retracts in a uniform manner upon itself.

The exterior of the OUTER STRUCTURE (3) has a slight inwards taper near its base. This is to accommodate for the horizontal bars at either end of the HOOKING MECHANISM (1) and thereby allow the HOOKING MECHANISM (1) to rest in the "V", "U", or RECTANGULAR SHAPED FEMALE DEPRESSIONS (19). The inwards taper is limited by the outer circumference of the GUIDANCE COLLARS (12) in combination with the overall size of the OUTER STRUCTURE (3). The COMMON SHAFT (10) has BEARING ASSEMBLIES (13) of at least one bearing, preferably two, each being attached at the inner race to the COMMON SHAFT (10) outboard of the GUIDANCE COLLARS (12), with the outer race fixedly attached to the OUTER STRUCTURE (3). The COMMON SHAFT (10) has at least one RETRACTABLE SPRING MECHANISM(s) (14), preferably two, each located outboard of the BEARING ASSEMBLIES (13). The RETRACTABLE SPRING MECHANISM (14) is rigidly attached to the rotatable COMMON SHAFT (10) and to the non-rotatable OUTER STRUCTURE (13). Spring tension is built up by pulling the HOOKING MECHANISM (1) out and away from its cradle in the OUTER STRUCTURE (3) and running the full length of the WEBBING (2) out. For reliability, there is not a ratchet lock mechanism. Therefore the spring tension built up is always present when the HOOKING MECHANISM (1) is deployed. Shown best in FIGS. 3 and 4, is an EXTERIOR WHEEL (15) outboard of the RETRACTABLE SPRING MECHANISM (s) (14), and fixedly attached to the COMMON SHAFT (10) its extreme ends. The EXTERIOR WHEEL (15) has a FINGER DEPRESSION (20) on its exterior near its outer circumference. This FINGER DEPRESSION (20) is meant to be used by a finger or thumb to crank in the WEBBING (2) if the RETRACTABLE SPRING MECHANISM(s) (14) should fail.

I claim:

1. A snowboard support system comprising:

a hooking mechanism;

a webbing having a first end and a second end; and an outer structure;

wherein the hooking mechanism is attached to the first end of the webbing and the outer structure is attached to the second end of the webbing, and wherein the hooking mechanism further comprises a hook and a push button release mechanism, wherein the hook further comprises:

at least one curved finger; and an end;

wherein the at least one curved finger has an inner radius, wherein the inner radius conforms to an outer radius of a chair lift bar; and wherein the push button release mechanism further comprises:

a push button release mechanism female portion having a first end and a second end; and a push button release mechanism male portion having a first end and a second end;

wherein the push button release mechanism female portion rigidly attaches to the at least one curved finger thereby allowing the user to release the push button release mechanism male portion that is attached to the webbing.

2. A snowboard support system according to claim 1, wherein the hooking mechanism further comprises a bottom end attached to the first end of the webbing.

3. A snowboard support system according to claim 1, wherein the hook comprises:

two curved fingers each having a first end; and a bar;

wherein the two curved fingers are set equidistant from another and joined at the first ends by the bar which is positioned perpendicular to the first ends.

4. A snowboard support system according to claim 3, wherein the hook further comprises an additional bar attached to the two fingers and has a pull tab attached around the bar thereby allowing the user to pull the hook mechanism away from the outer structure.

5. A snowboard support system according to claim 1, wherein the hooking mechanism further comprises a pull tab attached to the at least one finger thereby allowing the user to deploy and retract the hooking mechanism from the outer structure.

6. A snowboard support system according to claim 1, wherein the hooking mechanism further comprises the push button release mechanism male portion wherein the first end interlocks with the push button release mechanism female portion and the second end is attached to the webbing and allows adjustment of the length of the webbing.

7. A snowboard support system according to claim 1, wherein the outer structure further comprises:

a common shaft;

wherein the first end of the webbing is adjustably attached to the push button release mechanism male portion and the second end of the webbing is non-adjustably attached to the common shaft.

8. A snowboard support system according to claim 1, wherein the outer structure further comprises an at least one retractor spring mechanism;

an at least one outer wall;

an at least one bearing assembly;

an at least one guidance collar; and a common shaft having an at least one end;

wherein the at least one outer wall houses the at least one retractor spring mechanism;

wherein the at least one bearing assembly is inboard the at least one retractor spring mechanism;

wherein the at least one guidance collar is inboard the at least one bearing assembly; and wherein the at least one retractor mechanism, the at least one bearing assembly and the at least one guidance collar are connected together by the common shaft.

9. A snowboard support system according to claim 8, wherein the at least one retractor spring mechanism further comprises:

an outer diameter; and an inner diameter;

wherein the outer diameter is attached to the outer structure and the inner diameter is attached to the common shaft.

10. A snowboard support system according to claim 8, wherein the at least one bearing assembly further comprises:

an outer race; and an inner race wherein the outer race is stationarily fixed to the outer structure and the inner race is fixed to the common shaft thereby supporting the common shaft and allowing the common shaft to rotate while maintaining alignment.

11. A snowboard support system according to claim 8, wherein the at least one guidance collar is fixed to the common shaft providing a space between the at least one guidance collar thereby allowing the webbing to wrap around the common shaft in a uniform manner.

12. A snowboard support system according to claim 8, wherein the outer structure further comprises:

an exterior wheel having an inner diameter and an outer diameter; and an at least on finger depression;

wherein the exterior wheel is fixed at its inner diameter to the at least one end the common shaft and including the at least one finger depression located at the outer diameter.

13. A snowboard support system according to claim 8, wherein the outer wall of the outer structure further comprises:

a retention bar;

wherein the retention bar locks the hooking mechanism in place while stored on the outer structure.

14. A snowboard support system according to claim 13, wherein the retention bar further comprises:

a compression spring; and a pivot pin having an external diameter; a rounded head; and an other end;

wherein the compression spring is located around the external diameter of the pivot pin; and the pivot pin is located at mid span of the retention bar; and the pivot pin being rigidly attached at the other end to the retention bar with the rounded end passing through the outer structure, and wherein the rounded head is larger than the external diameter of the pivot pin thereby securing the retention bar to the outer structure.

15. A snowboard support system according to claim 13, wherein the retention bar further comprises:

an at least one outboard end; and an at least one vertical projection;

wherein the at least one vertical projection is rigidly attached near the at least one outboard end of the retention bar thereby allowing the user to rotate the retention bar.

16. A snowboard support system according to claim 15, wherein the retention bar further comprises:

an at least one rounded edge; and wherein the outer structure further comprises:

an at least one slight depression; and an at least one side wall;

wherein the at least one rounded edge allows the retention bar to rotate and frictionally engage into the at least one slight depression located in the at least one side wall of the outer structure.

17. A snowboard support system according to claim 1, wherein the outer structure further comprises:

an at least one female depression; and an at least one bracket;

wherein the at least one female depression is capable of accepting the at least one bracket to secure the outer structure to the snowboard.

18. A snowboard support system according to claim 17, wherein the at least one female depression can be a shape selected from the group consisting of a v-shape, a u-shape, a rectangular shape, and a square shape.

19. A snowboard support system according to claim 1, wherein the outer structure stores the hooking mechanism.

20. A snowboard support system according to claim 1, wherein the outer structure further comprises:

an at least one drain hole;

an at least one lower wall;

and a base;

wherein the at least one drain hole is located proximal to the lower walls or the base of the outer structure.

21. A snowboard support system according to claim 1, wherein the outer structure further comprises:

a rectangular opening having a rounded lip;

wherein the rectangular opening having the rounded lip prevents the fraying of the webbing during extraction and retraction.

22. A snowboard support system according to claim 1, wherein the outer structure further comprises:

an at least one bearing supported elongated wheel;

an upper opening; and a lower opening;

wherein the at least one bearing supported elongated wheel is located on the upper and lower openings to prevent fraying of the webbing during extraction and retraction.

23. A snowboard support system comprising:

a hooking mechanism;

a webbing having a first end and a second end; and an outer structure;

wherein the hooking mechanism is attached to the first end of the webbing and the outer structure is attached to the second end of the webbing, wherein the outer structure further comprises an at least one outer wall, and wherein the at least one outer wall further comprises a retention bar comprising:

a compression spring; and a pivot pin having an external diameter; a rounded head; and an other end;

wherein the compression spring is located around the external diameter of the pivot pin; and the pivot pin is located at mid span of the retention bar; and the pivot pin being rigidly attached at the other end to the retention bar with the rounded end passing through the outer structure, and wherein the rounded head is larger than the external diameter of the pivot pin thereby securing the retention bar to the outer structure.

* * * * *